US006358098B1

(12) United States Patent
Wakata

(10) Patent No.: US 6,358,098 B1
(45) Date of Patent: Mar. 19, 2002

(54) TERMINAL AND A JOINT CONNECTOR

(75) Inventor: Shigekazu Wakata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/663,504

(22) Filed: Sep. 15, 2000

(30) Foreign Application Priority Data

Sep. 28, 1999 (JP) ..... 11-274988

(51) Int. Cl.[7] ..... H01R 13/502

(52) U.S. Cl. ..... 439/701; 439/717

(58) Field of Search ..... 439/701, 717, 439/177, 907, 594, 752, 731, 540.1, 510, 512, 513

(56) References Cited

U.S. PATENT DOCUMENTS 6,123,553 A * 9/2000 Kobayashi et al. ..... 439/77

FOREIGN PATENT DOCUMENTS

JP 8-306451 11/1996

* cited by examiner

*Primary Examiner*—Gary Paumen
*Assistant Examiner*—Alexander Gilman
(74) *Attorney, Agent, or Firm*—Anthony J. Casella; Gerald E. Hespos

(57) ABSTRACT

A joint connector is provided to solve problems of later-inserted terminals and to enable both an increase of wires to be joined and a circuit change. A terminal (6) of such a joint terminal includes a terminal connecting portion (10) in the form of a rectangular tube provided at a front part of the terminal (6). A tab-shaped joint portion (15) projects forward from a ceiling wall (10B) of the terminal connecting portion (10). The joint portion (15) is caused to project forward through a joint portion drawing opening (2C) of a connector housing (3) and is then folded substantially in U-shape. When the connector housings (3) are assembled one over another, the joint portions (15) of the terminals (6) mounted in the lower connector housing(s) (3) are pushed into the terminal connecting portions (10) of the terminals (6) mounted in the upper connector housing(s), thereby connecting the terminals (6) provided one over another.

13 Claims, 21 Drawing Sheets

TERMINAL AND A JOINT CONNECTOR

BACKGROUND OF THE INVENTION

1. Field of the Invention

The present invention relates to a terminal for a joint connection and a joint connector having such a terminal mounted therein.

2. Description of the Related Art

Joint connectors conventionally are used to connect wires used in a common circuit system, such as a ground line. One such prior art connector is disclosed in Japanese Unexamined Patent Publication No. 8-306451, and is shown in FIGS. 24 and 25 of this application. The prior art joint connector of FIGS. 24 and 25 has terminals 102 that are accommodated in cavities 101 of a connector housing 100.

The prior art connector housing 100 is formed with the cavities 101 at four stages, and the cavities 101 communicate with each other in the vertical direction through openings. Insertion openings 101A are formed at the front ends of the cavities 101. On the other hand, each terminal 102 has first elastic contact pieces 103 at its upper portion, a second elastic contact piece 104 inside, and a connecting portion 105 at its lower portion.

Upper and lower terminals 102A and 102B are accommodated in the connector housing 100, such that the first elastic contact pieces 103 of the lower terminal 102B contact the connecting portion 105 of the upper terminal 102A as shown in FIG. 25. Mating male terminals 106 can be inserted through the insertion openings 101A, and contact the second elastic contact pieces 104 of the terminals 102. Thus, these terminals can meet a demand to join an increased number of wires.

However, even if the above-described terminals are used, there is a limit on the number of wires that can be joined due to the number of the cavities 101 in the connector housing 100. As a result, several kinds of connector housings 100 must be prepared depending upon the required circuit configuration. Further, since the terminals 102A, 102B located one over the other always are joined, the connector housing 100 is unsuitable when a circuit to be constructed does not require such a joint connection.

The manufacture of a wiring harness generally requires subassemblies S1 to S3 to be assembled first, as shown in FIG. 26. Terminals at ends of wires that are to be connected with another subassembly are left exposed without being inserted into connectors. These are referred to as later-inserted terminals T1 to T3. The subassemblies S1 to S3 are assembled into a final wiring harness W/H on a worktable, and the later-inserted terminals T1 to T3 are inserted into the connectors of the other subassemblies at this stage, or are joined by being inserted into the joint connector. However, the assembling of the final wiring harness W/H is not efficient because it is essential to insert the later-inserted terminal during the final assembling. Further, since the assembling of the subassemblies S1 to S3 and the assembling of the final wiring harness W/H usually are performed at separate locations, the later-inserted terminals T1 to T3 are likely to be deformed or damaged during transportation if left exposed in the subassemblies S1 to S3. Once these terminals T1 to T3 are deformed or damaged, it is difficult to insert them into the connector housings.

The present invention was developed to solve the above problem of later-inserted terminals, and an object thereof is to provide a terminal and a corresponding joint connector that facilitates use with an increase of wires to be joined and a circuit change.

SUMMARY OF THE INVENTION

The subject invention is directed to a terminal, which comprises a wire connecting portion, a terminal connecting portion and a joint portion. The wire connecting portion is for connection with an end of a wire. The terminal connecting portion is for receiving or being connected to another terminal as a joint partner. The joint portion preferably is tab-shaped, and extends forward from the terminal connecting portion substantially along a longitudinal direction and can be folded back or bent. The folded or bent joint portion then can be inserted into connection with a terminal connecting portion of another terminal as a joint partner. However, the joint portion preferably is configured and disposed to be cut off from the terminal connecting portion if the joint portion is not needed.

The invention also is directed to a joint connector, that comprises connector housings. Each connector housing is formed with cavities that extend substantially in forward and backward directions and that preferably are arranged substantially horizontally and side by side. The above-described terminals are at least partly accommodated in the connector housings. The joint portion of each terminal can be folded or bent back and positioned substantially parallel to the corresponding cavity, but outside the corresponding connector housing.

Preferably, the connector housings are assembled substantially one over another. Thus, a joint portion in one connector housing may be inserted into a cavity of a connector housing located one stage above or below, and further into the terminal connecting portions of the terminals accommodated in the corresponding cavities to connect the terminals with each other.

Joining portions preferably are provided on opposing surfaces of connector housings that are located substantially one over the other. The joining portions may comprise projections and recesses in the respective connector housings, and prevent vertical separation of connector housings that are located substantially one over the other. The joining portions also are configured for permitting the connector housings to be slid in forward and backward directions into engagement with each other. Thus the joining portions can be inserted into the terminal connecting portions of the terminals located one stage above or below as the connector housings located one over the other are assembled by a sliding movement.

A cover may be provided for substantially covering the folded sections of the joint portions exposed at the front surfaces of the respective connector housings. The cover may be mounted on a block constructed by assembling the connector housings substantially one over another preferably while engaging the joining portions with each other.

Receiving portions preferably are formed on the outer surfaces of the connector housings. The receiving portions are aligned vertically when the block is constructed by assembling properly aligned connector housings substantially one over another. The cover is formed with a detecting portion that can be slid into the receiving portions substantially in a vertical direction when the block is constructed properly. The detecting portions, however, make it impossible for the cover to slide further when the block is constructed with the connector housings and their receiving portions misaligned.

Most preferably, the cover includes holes in positions substantially corresponding to the cavities for receiving the terminals as joint partners from outside the block.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
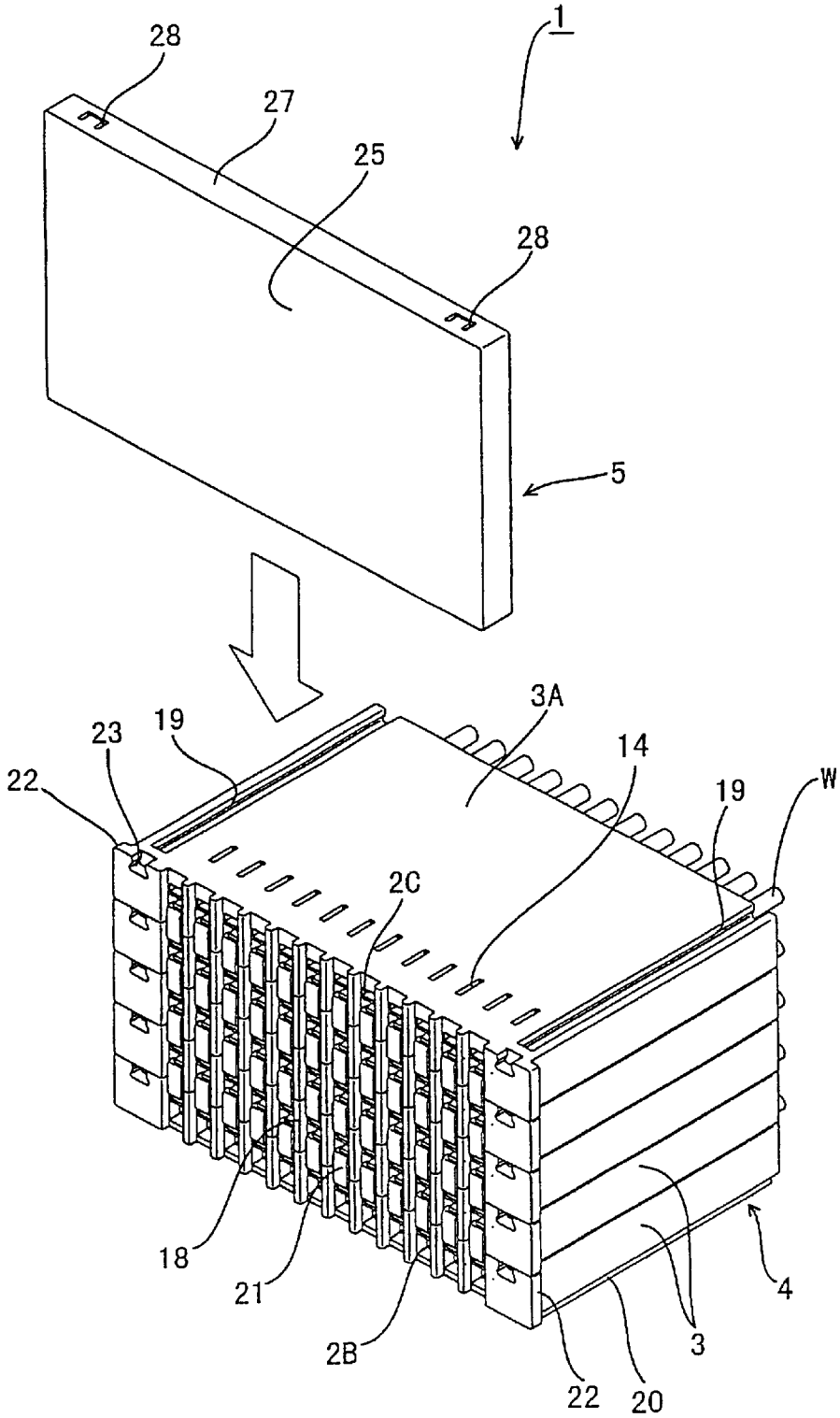
FIG. 1 is a perspective view showing a block and a cover member.
Figure 2:
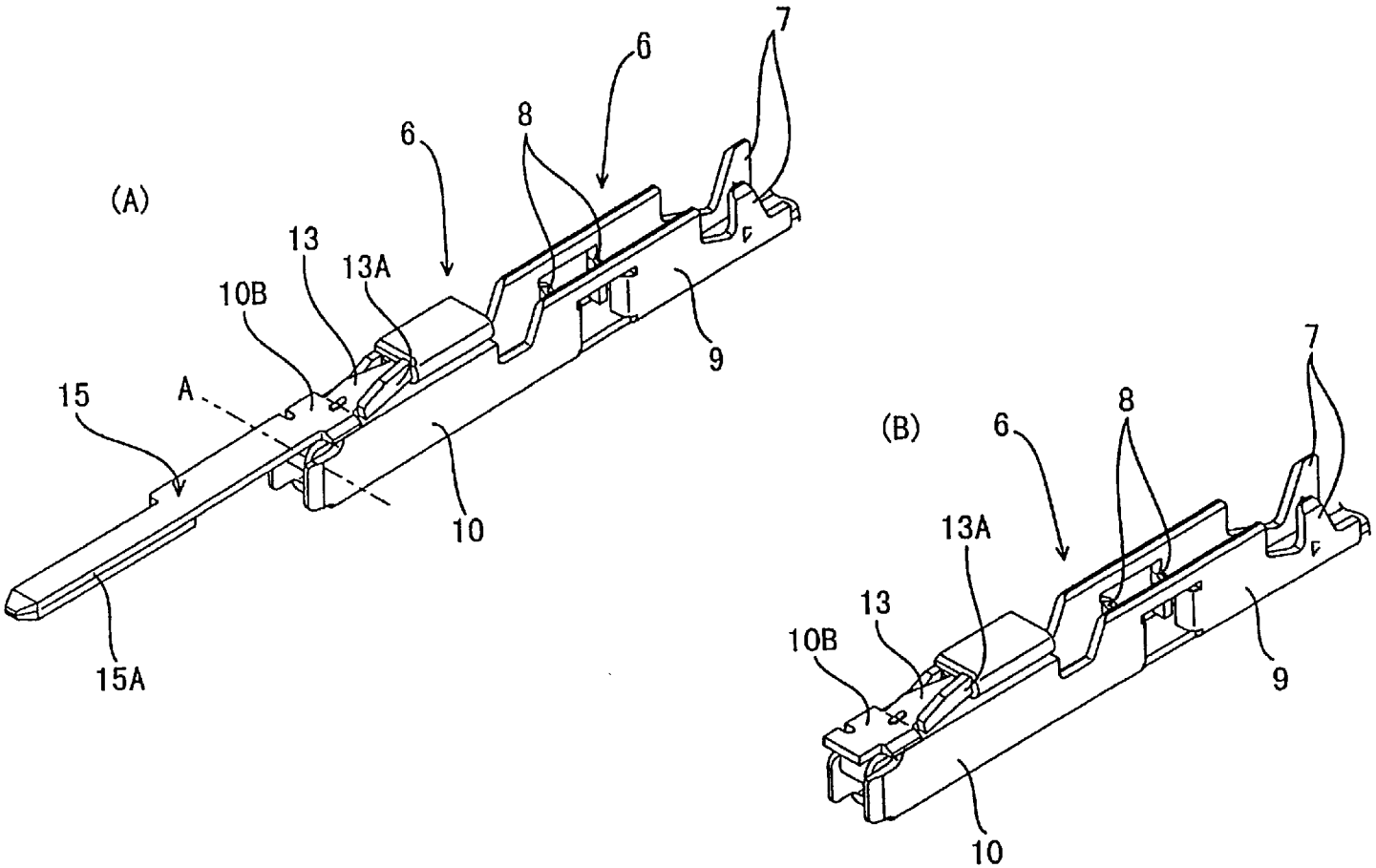
FIG. 2A is a perspective view of a terminal having a joint portion.
FIG. 2B is a perspective view of a terminal having a joint portion cut off.
Figure 3:
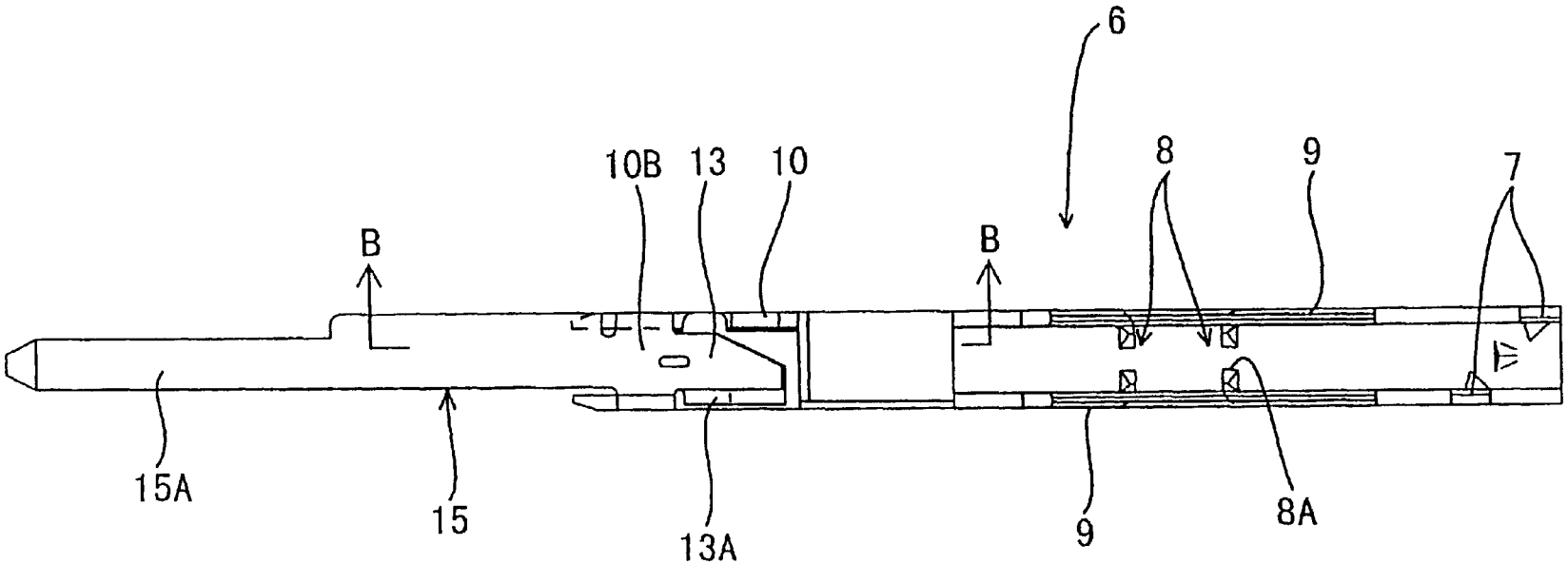
FIG. 3 is a plan view of the terminal.

A joint connector in accordance with the present invention is identified generally by the numeral 1 in FIG. 1. The joint connector 1 is comprised of a block 4 constructed by assembling a plurality of connector housings 3 one over another. Each connector housing 3 has a plurality of substantially linearly or horizontally arranged cavities 2, with the cavities 2 of one connector housing 3 being arranged over the cavities 2 of the adjacent connector housing 3 of the block 4. A cover 5 is mounted on the front surface of the block 4, as described later. Terminals 6 are accommodated in the respective connector housings 3, and are connected with wire harness subassemblies. The connector housings 3 are placed substantially one over another at the time of final assembling.

The terminal 6, as shown in FIGS. 2–7, is formed e.g. by bending an electrically conductive metal plate. Two insulation barrels 7 are provided at the rear end of the terminal 6 for crimped connection with an insulation coating of a wire W. Insulation-displacement portions 8 are provided forward of the insulation barrels 7. The insulation-displacement portions 8 are formed e.g. by cutting portions of left and right side walls 9 and bending the cut portions such that grooves 8A are defined between the substantially opposed ends of front and rear pairs of bent portions of the opposite side walls 9. The wire W can be pushed into the grooves 8A, and the opposed edges of the bent portions cut the insulation coating of the wire W to establish electrical connection between the insulation-displacement portions 8 and a core of the wire W.

A terminal connecting portion 10 is provided forward of the insulation-displacement portions 8 for connection with a terminal as a joint partner. The terminal connecting portion 10 is substantially in the form of a rectangular tube and is hollow in forward and backward directions. The ceiling wall of the terminal connecting portion 10 preferably has a double-layer construction of inner and outer ceiling walls 10A and 10B (see FIG. 5).

A front part of the inner ceiling wall 10A is bent inward and turned to have a substantially triangular cross section, thereby forming an elastic contact piece 11. An apex of the elastic contact piece 11, which is the portion of the elastic contact piece 11 projecting most inwardly inside the terminal connecting portion 10, is stamped to project further inwardly, thereby forming a contact portion 11A. An excessive deformation preventing piece 12 projects down from the inner ceiling wall 10A forming the elastic contact piece 11 in a position corresponding to the contact portion 11A. The excessive deformation preventing piece 12 contacts the rear side of the contact portion 11A before the elastic contact piece 11 is deformed preferably beyond its limit of elasticity, thereby preventing any further deformation of the elastic contact piece 11.

The outer ceiling wall 10B is formed with an elastically deformable locking portion 13. One side edge of the locking portion 13 is bent outward to form a hook 13A, which is engaged elastically in a lock hole 14 of the connector housing 3 to prevent the terminal 6 from coming out of the corresponding cavity 2 of the connector housing 3.

Figure 4:
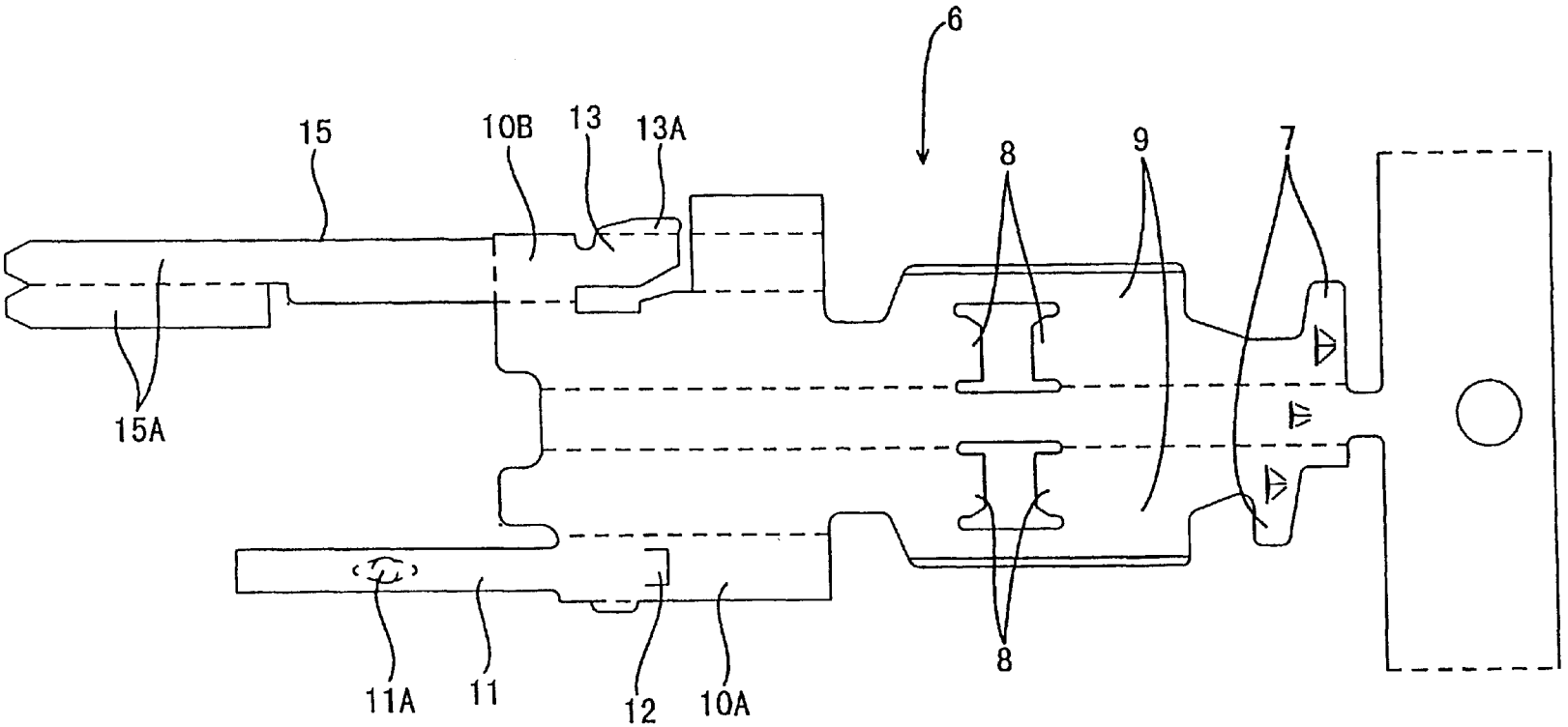
FIG. 4 is a development of the terminal.
Figure 5:
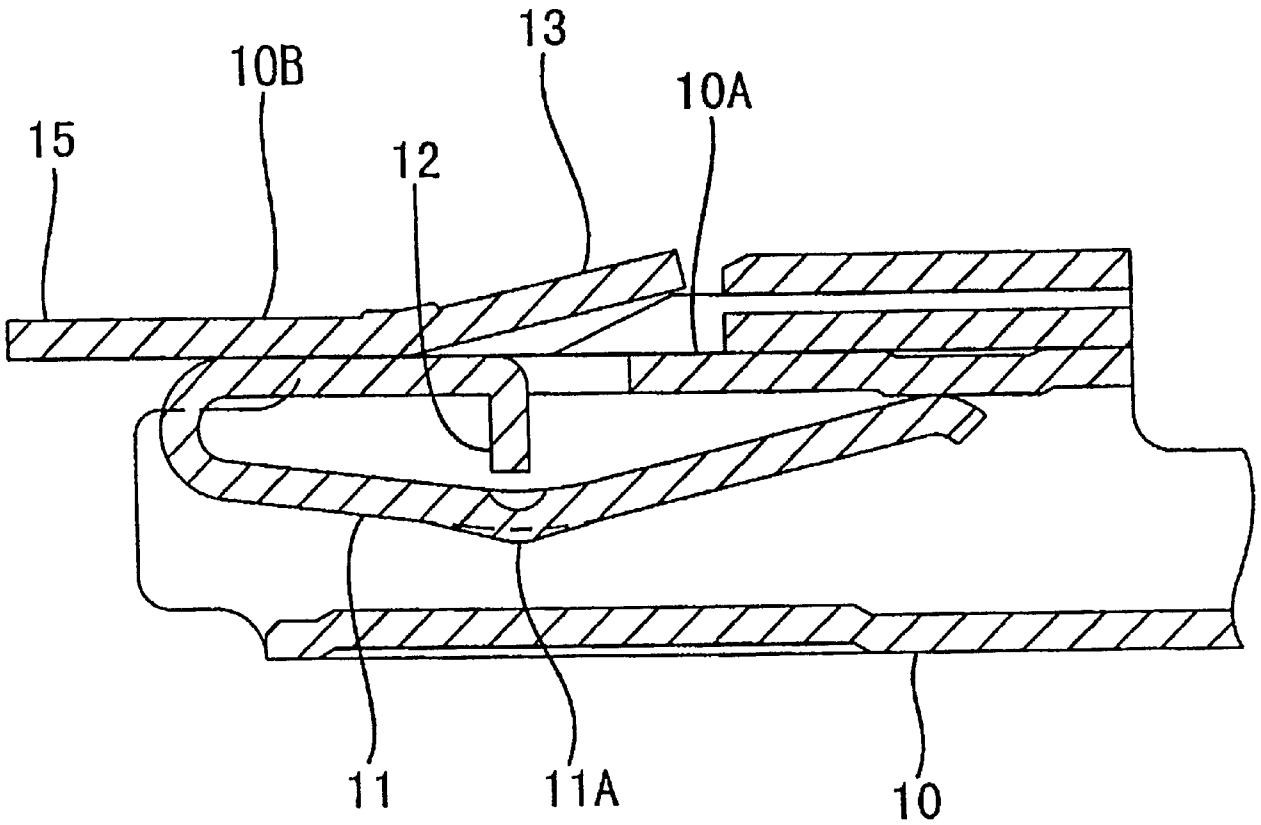
FIG. 5 is an enlarged section of a terminal connecting portion.
Figure 21:
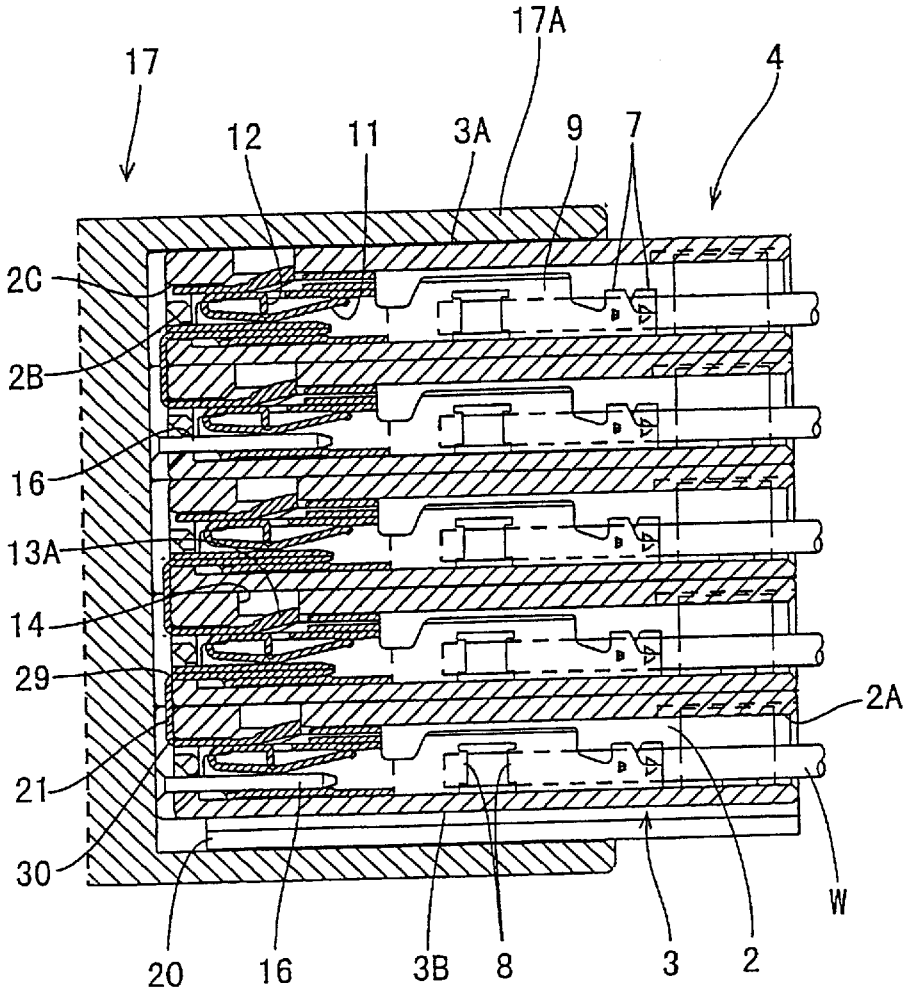
FIG. 21 is a section showing a state of connection between the block and an electrical connection box.

A joint portion 15 projects substantially horizontally from the outer ceiling wall 10B in a direction substantially opposite to the locking portion 13, i.e. in forward direction. The joint portion 15 is in the form of a tab that can be inserted into the terminal connecting portion 10 of the terminal 6 located one stage above. The joint portion 15 is described in detail later. In this embodiment, the half of the joint portion 15 closest to the terminal connecting portion 10 is a single-plate. However, the half of the joint portion 15 further from the terminal connecting portion 10 is formed by folding back one side portion of the plate along a longitudinal direction to define a folded-back portion 15A, as shown in FIG. 4. The folded-back portion 15A is provided so that the joint connector 1 also may be connected with a tab 16 of a busbar of an electrical connection box 17, as shown in FIG. 21. The tab 16 of the busbar is about twice as thick as the plate material of the terminal 6. Therefore, the thickness of the terminal 6 substantially conforms or corresponds to the thickness of the tab 16 by forming the folded-back portion 15A at the leading end of the joint portion 15. Accordingly, the terminal 6 can be used when the joint connector 1 is singly used as well as when the joint connector 1 is used together with the electrical connection box 17. The folded-back portion 15A is narrower than sections of the joint portion 15 behind the folded-back portion 15.

Figure 6:
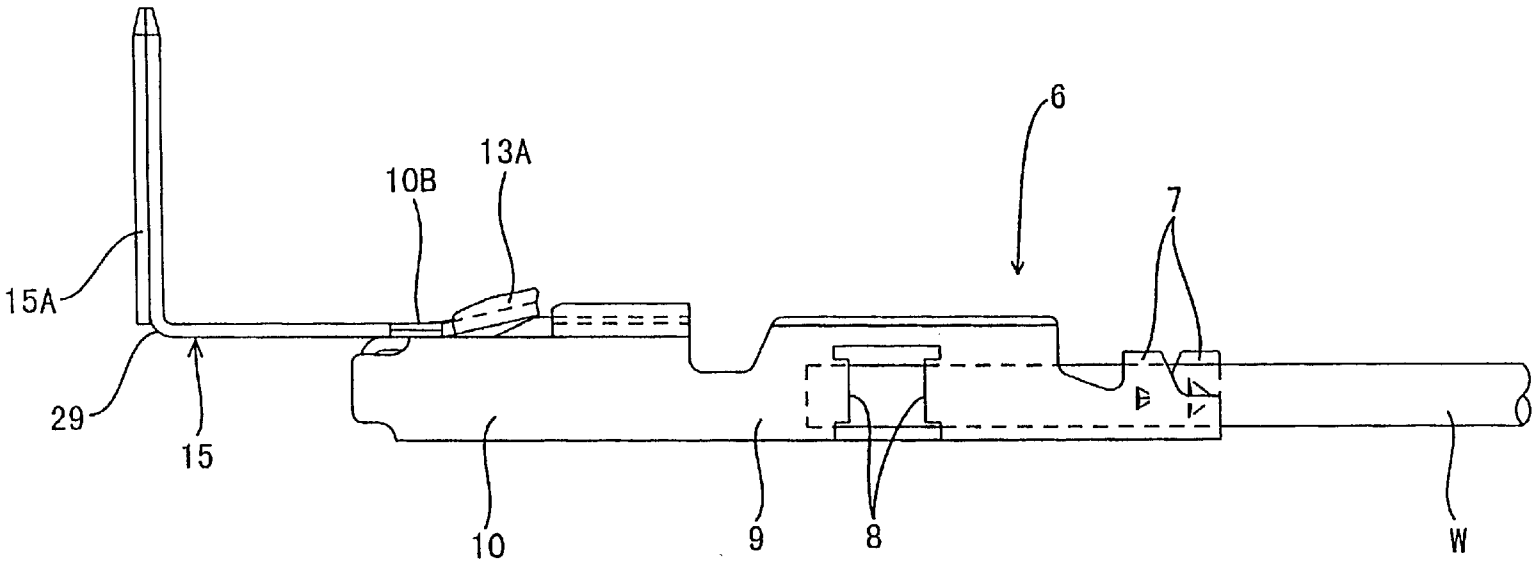
FIG. 6 is a side view showing a state of the terminal after first bending of the joint portion.
Figure 7:
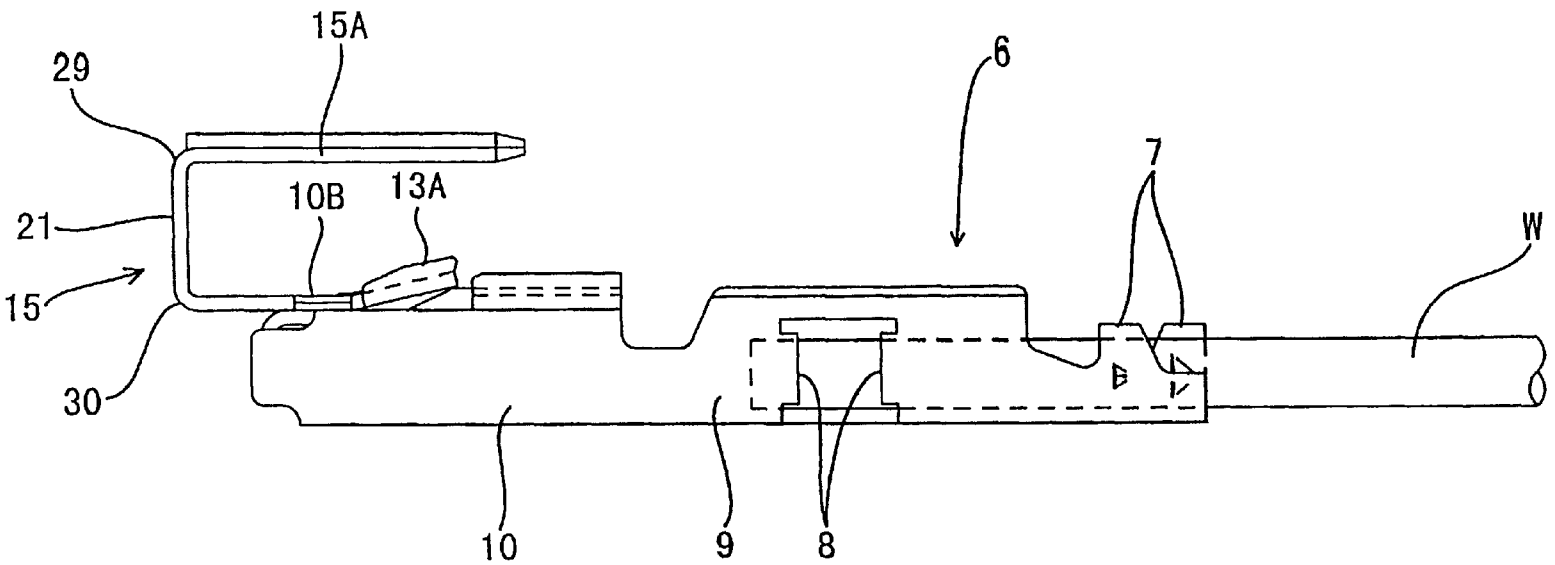
FIG. 7 is a side view showing a state of the terminal after second bending of the joint portion.

The joint portion 15 is first bent at an angle different from 0° or 180°, and preferably at substantially right angles at the rear end of the folded-back portion 15A to define a first bent portion 29, as shown in FIG. 6. The joint portion 15 is bent again at an angle different from 0° or 180°, and preferably at substantially right angles at the base end thereof to define a second bent portion 30, as shown in FIG. 7. Thus, the joint portion 15 is formed into a substantially U-shape. With this construction, the terminal 6 can be accommodated in a cavity of one connector housing 3, and the U-shaped joint portion 15 can enter a cavity 2 of the next-higher connector housing 3 while being held substantially in close contact with the front surfaces of both connector housings 3.

As explained above, the joint portion 15 can be used for the joint connection with the terminal 6 provided one stage above. However, in some instances, the joint portion is not required, and may be cut off at a location indicated by the phantom line A of FIG. 2(A).

Figure 11:
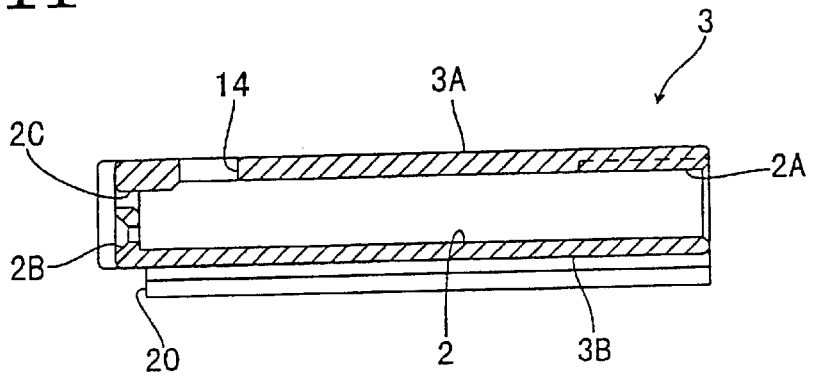
FIG. 11 is a side view in section of the connector housing.

The connector housing 3 is integrally or unitarily formed e.g. of a synthetic resin material. A plurality of cavities 2 are formed substantially side by side inside the connector housing 3, and extend in a longitudinal or forward and backward direction, as shown in FIG. 11. Each cavity 2 has a rear opening 2A at the rear side of the connector housing 3 and both an insertion opening 2B and a joint portion drawing opening 2C at the front side of the connector housing 3. The aforementioned terminal 6 can be inserted at least partly into the cavity 2 through the rear opening 2A. Further, the joint portion 15 of the mating terminal 6 or the tab portion 16 of the busbar can be inserted through the insertion opening 2B for connection with the terminal connecting portion 10 of the terminal 6. The joint portion drawing opening 2C is formed above the insertion opening 2B of the respective cavity 2, and the joint portion 15 of the terminal 6 in one of the cavities 2 can be drawn out of the connector housing 3 through the joint portion drawing openings 2C. A lock hole 14 is formed near the leading end of the ceiling wall of each cavity 2, and is dimensioned to engage the locking portion 13 of the terminal 6 inserted into the cavity 2. Further, substantially vertical partition walls 18 project from the front surface of the connector housing 3 for partitioning the cavities 2.

Figure 8:
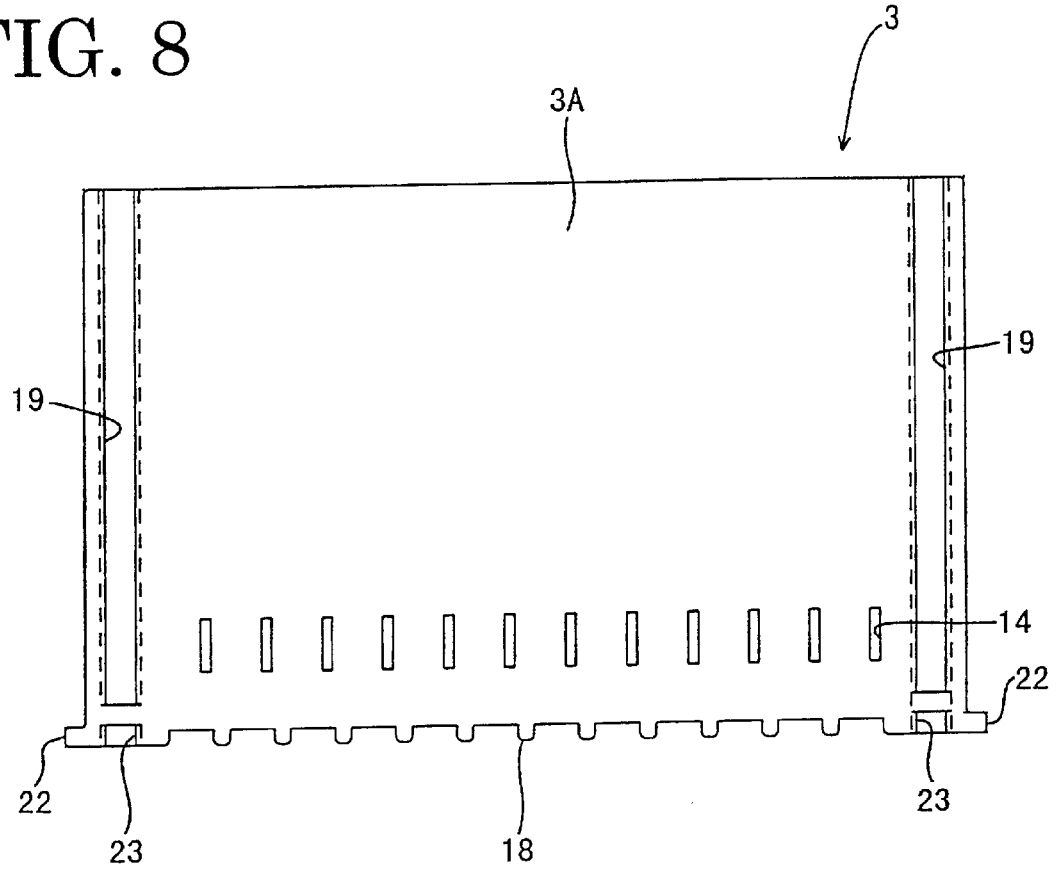
FIG. 8 is a plan view of a connector housing.
Figure 9:
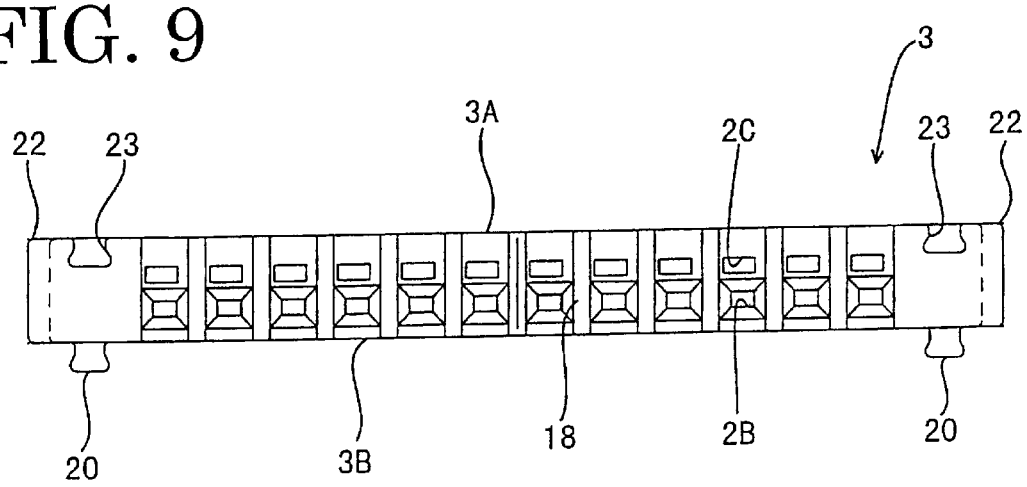
FIG. 9 is a front view of the connector housing.
Figure 10:
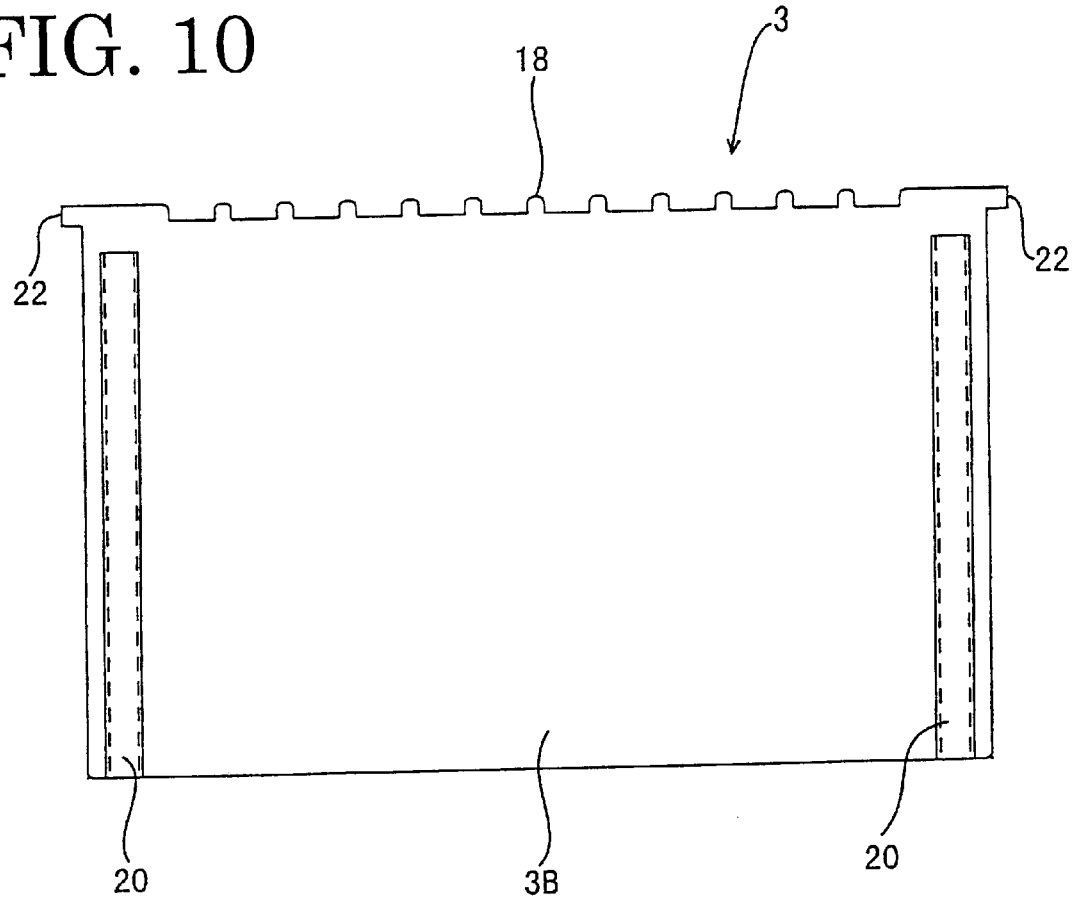
FIG. 10 is a rear view of the connector housing.

The respective connector housings 3 are assembled substantially one over another preferably by grooves 19 and elongated projections 20. Specifically, left and right grooves 19 are formed at the opposite sides of the upper surface 3A of each connector housing 3 and extend in longitudinal or forward and backward directions, as shown in FIG. 8. The starting end of each groove 19 is located slightly backward from the front surface of the connector housing 3, but each groove 19 extends entirely to the rear end of the connector housing 3. The grooves 19 have larger widths at their bottoms than at their opening edges, such that each groove 19 has a dovetail-shaped cross section.

Left and right elongated projections 20 are formed on the bottom surface 3B of each connector housing 3 at locations that correspond to the grooves 19. Additionally, the projections 20 extend over substantially the same range as the terminal connecting portion 10. The elongated projections 20 have a dovetail shape that corresponds to the cross sectional shape of the grooves 19. Thus, two connector housings 3 can be assembled one over the other by aligning the leading ends of the elongated projections 20 of one connector housing 3 with the rear ends of the grooves 19 of the other connector housing 3 and sliding the elongated projections 20 along the grooves 19.

A plurality of connector housings 3 can be placed one over another and assembled, as described above. As a result, intermediate sections of the joint portions 15 of the terminals 6, that is sections of the joint portions 15 near and between the first and second bent portions 29, 30, are exposed at the front surfaces of the respective connector housings 3. Hereinafter, these exposed portions are referred to as folded portions 21. In this embodiment, a cover 5 is mounted to protect and/or substantially cover the folded portions 21. Accordingly, receiving portions 22 are formed integrally or unitarily at the left and right ends of the front surface of each connector housing 3 to project sideways substantially over the entire height of the connector housing 3. Further, one locking recess 23 is formed in the upper surface 3A of each connector housing 3 inwardly from each receiving portion 22. Each locking recess 23 is formed to have a larger width at its bottom than at its opening edge, and hence defines a dovetail-shaped cross section. Each locking recess 23 can engage a corresponding locking projection 24 on the cover 5.

Figure 18:
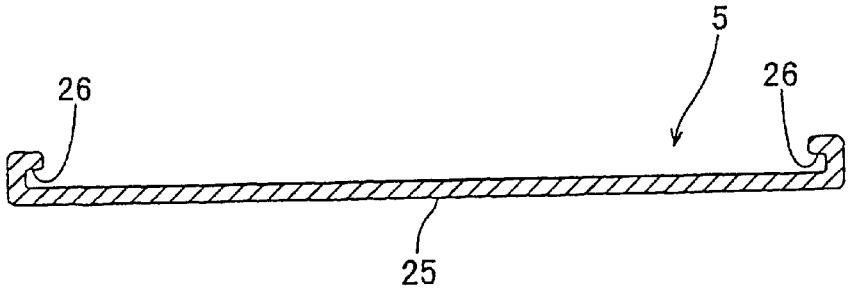
FIG. 18 is a section along A—A of FIG. 17.
Figure 19:
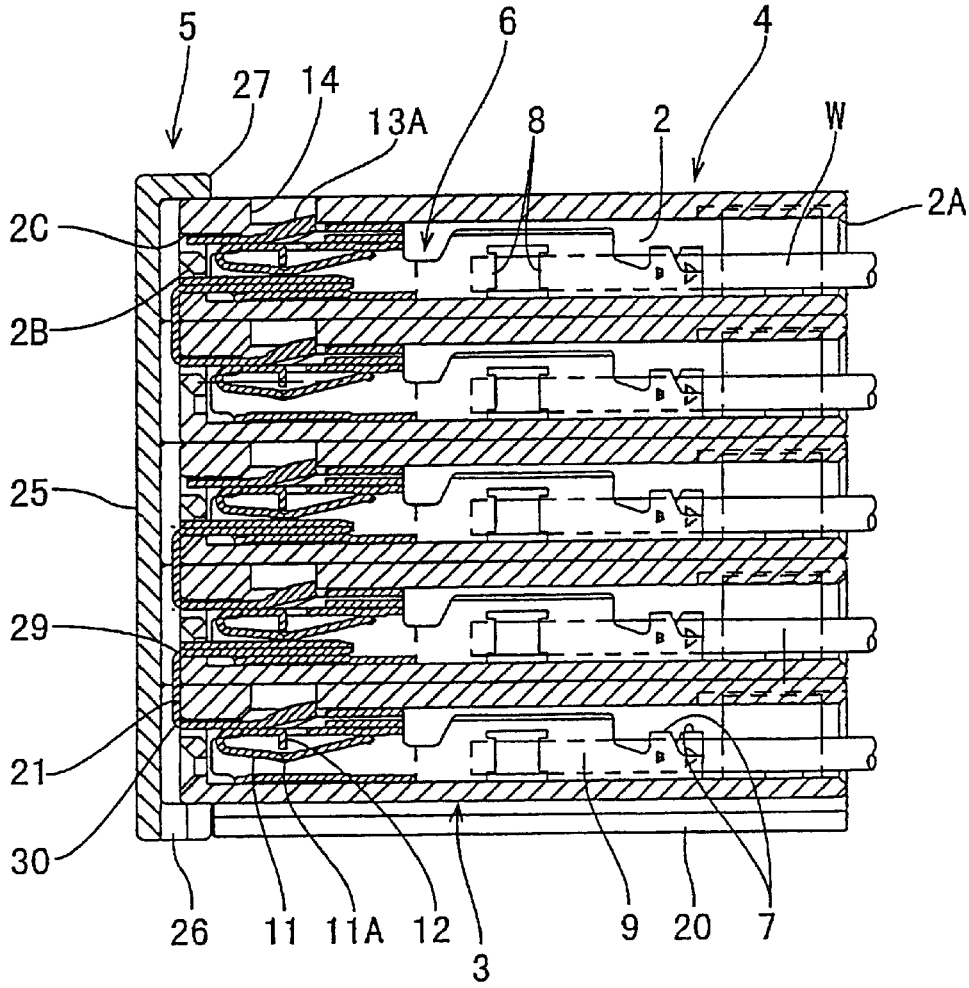
FIG. 19 is a section showing a state where the cover member is mounted on the block.

The cover 5 is integrally or unitarily formed e.g. of a synthetic resin that may be similar to the resin of the connector housings 3. As shown in FIGS. 17–20, the cover 5 includes a substantially rectangular protection plate 25 for substantially covering the front surface of the block 4 formed by assembling the connector housings 3 one over another. Opposite sides of the protection plate 25 are bent to form a pair of detecting portions 26 and to provide the protection plate 25 with a C-shaped cross section, as shown in FIG. 18. The receiving portions 22 of the connector housings 3 will be aligned vertically with one another if the connector housings 3 of the block 4 are assembled properly. Thus, the detecting portions 26 of the cover 5 can be slid along the aligned receiving portions 22 to cover the front of the block 4. However, the receiving portions 22 of the connector housings 3 will not all align vertically if the connector housings 3 of the block 4 are not assembled properly. Thus, the cover 5 will not completely cover the front of the block 4 because the detecting portions 26 and the misaligned receiving portions 22 will interfere with each other.

A closing plate 27 is provided at the upper edge of the protection plate 25 of the cover 5 to cover the upper ends of the detecting portions 26. Additionally locking projections 24 extend down from the left and right ends of the closing plate 27. The locking projections 24 have a larger width at their leading ends than at their base ends. The base end of each locking projection 24 is separated from the closing plate 27 by an angular groove 28 of substantially U- or C-shape (see also FIG. 1). Thus, the locking projections 24 are slightly elastically deformable.

Figure 12:
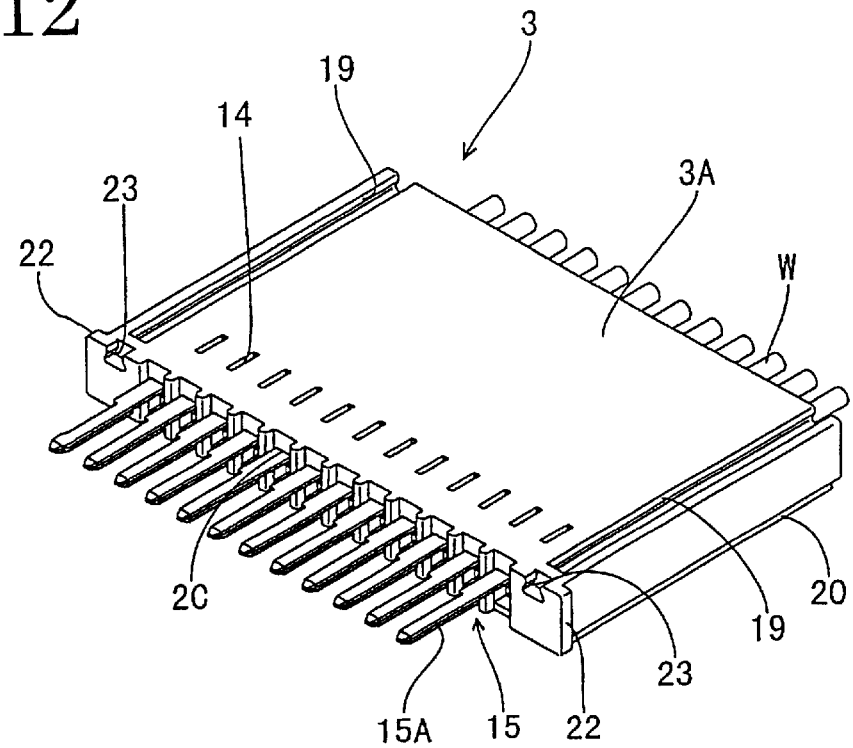
FIG. 12 is a perspective view of the connector housing when terminals are initially accommodated.

The block 4 is assembled and used as follows. First, the terminals 6, with the wires W connected to the rear ends, are mounted at least partly into the cavities 2 of the respective connector housings 3, as shown FIG. 12. The terminals 6 are locked in the corresponding cavities 2 by the hooking portions 13A of the locking portions 13 that fit into the respective lock holes 14. At this stage, any joint portions 15 that may be present on the terminals 6 extend through the joint portion drawing openings 2C and project out of the connector housing 3. The joint portions 15 are linear at this stage of the assembly.

Figure 13:
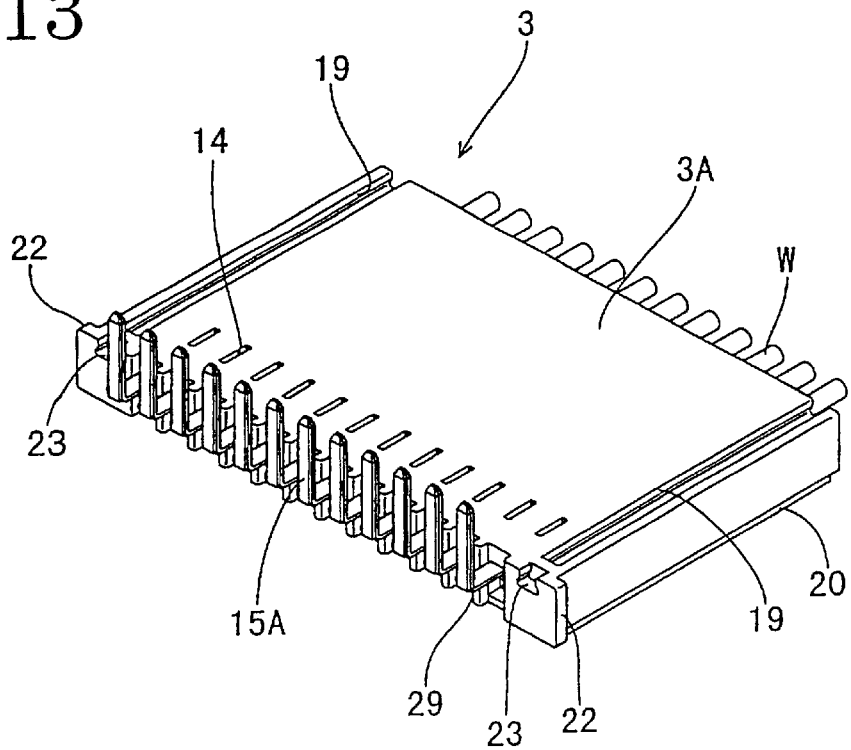
FIG. 13 is a perspective view of the connector housing after first bending of the terminals accommodated therein.

Next, the first bent portions 29 of the joint portions 15 are bent upward (see FIG. 13), and the second bent portions 30 thereof then are bent reward. As a result, the leading sections of the joint portions 15 are bent substantially in U-shape (see FIG. 14).

Figure 14:
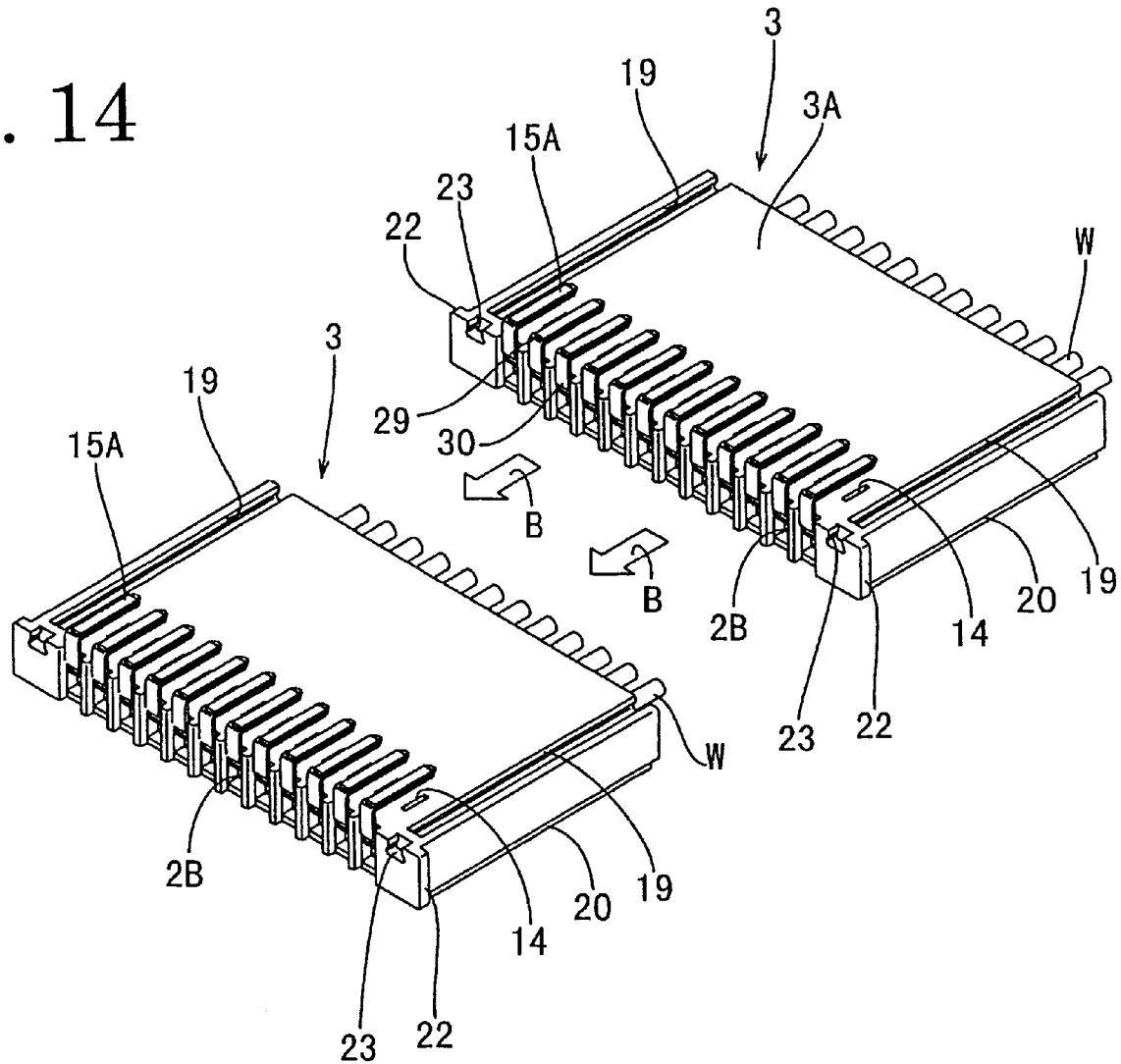
FIG. 14 is an exploded perspective view showing assembling of two connector housings.
Figure 15:
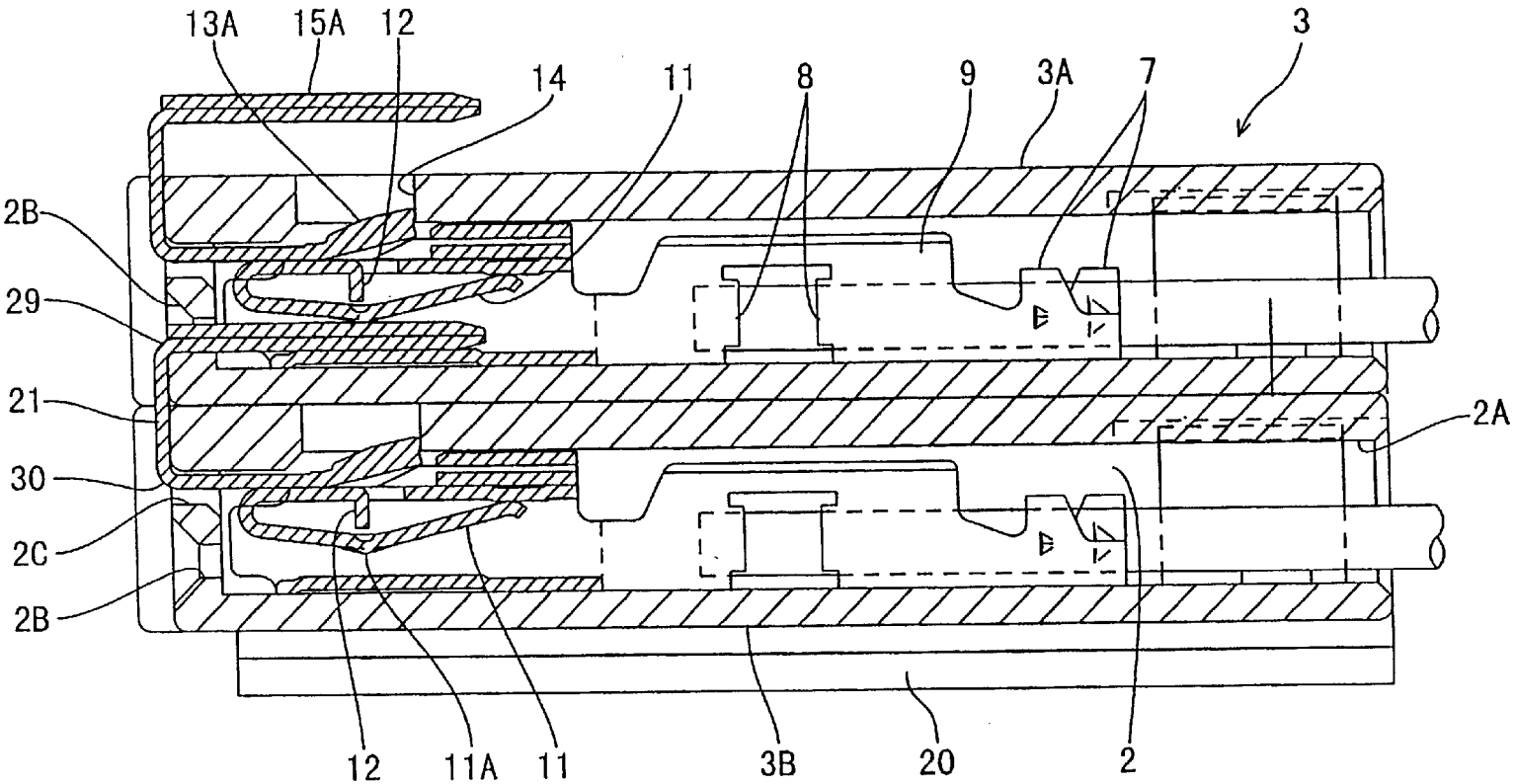
FIG. 15 is a section of two connector housings assembled one over the other.

The connector housings 3 with the terminals 6 and the joint portions 15 are placed substantially one over another. More particularly, the upper connector housing 3, shown at the right of FIG. 14, is placed above and behind the lower connector housing 3, shown at left of FIG. 14. The two elongated projections 20 of the upper connector housing 3 then are inserted into the rear ends of the grooves 19 of the lower connector housing 3, and the upper connector housing 3 is slid forwardly, as indicated by arrows B, to a specified position on the lower connector housing 3. Thus, the upper and lower connector housings 3 are assembled and are prevented from separating from each other. As the upper connector housings 3 is slid forwardly on the lower connector housing 3, the leading ends of the bent joint portions 15 that project from the lower connector housing 3 enter the cavities 2 through the insertion openings 2B open in the front surface of the upper connector housing 3. As a result, the bent joint portions 15 are inserted automatically into the terminal connecting portions 10 of the terminals 6 accommodated in the upper connector housing 3 to connect pairs of terminals 6 located one over the other (see FIG. 15).

Figure 16:
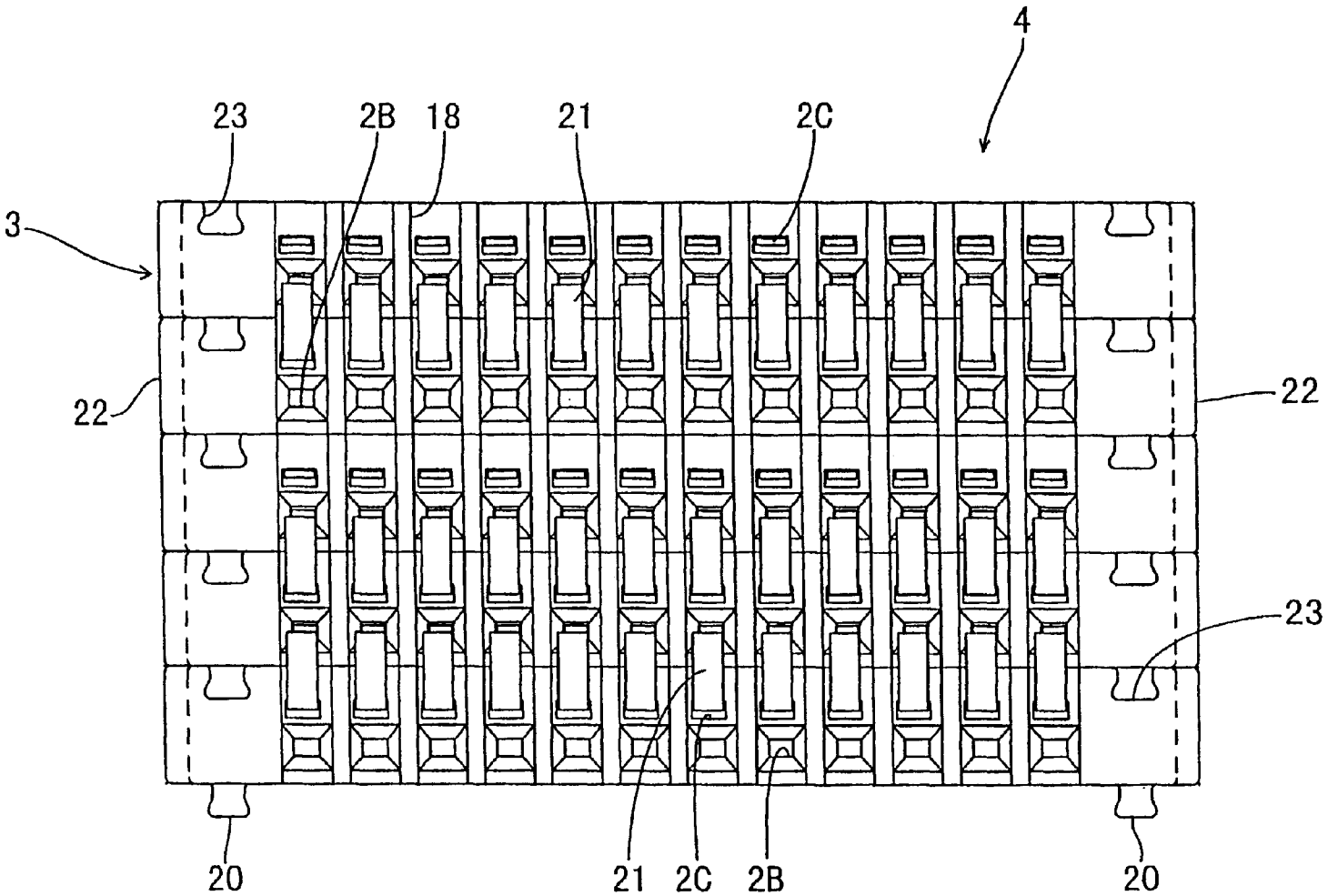
FIG. 16 is a front view of the block.
Figure 17:
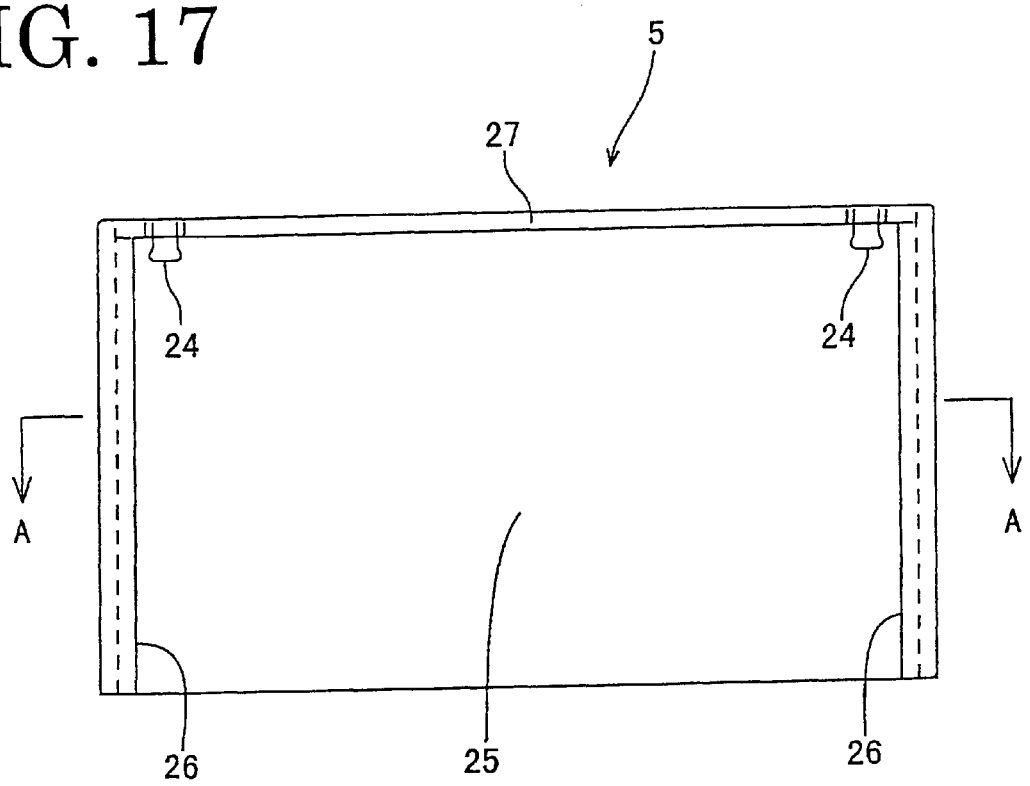
FIG. 17 is a rear view of a cover member.

The block 4 constructed by successively assembling the connector housings 3 one over another in this way is shown in FIG. 16. In the block 4 shown in FIG. 16, the joint portions 15 of the terminals 6 mounted in the connector housing 3 at the middle stage (third stage) have their leading portions cut off. Accordingly, a circuit configuration is created such that the terminals 6 in the same vertical rows of the connector housings 3 at the three lower stages are connected with each other, and those accommodated in the same vertical rows of the connector housings 3 at the two upper stages are connected with each other.

Figure 20:
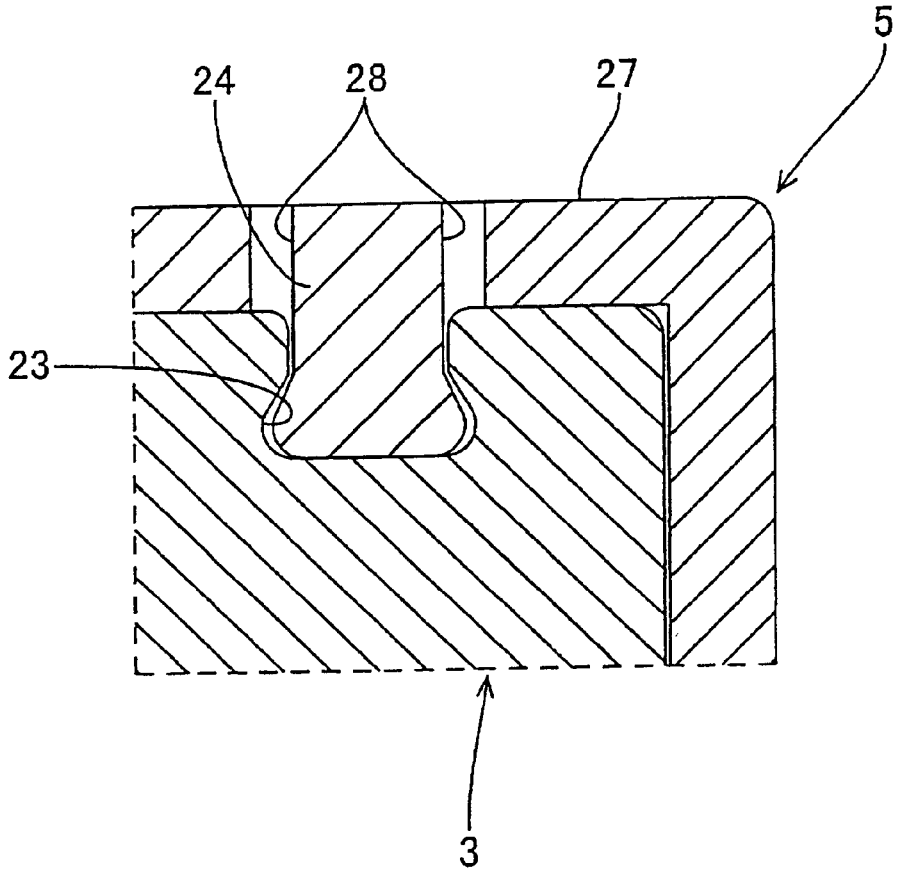
FIG. 20 is an enlarged section showing a locking portion of the cover member.

The cover 5 is mounted when the block 4 is not connected to the electrical connection box 17 or another connector. Thus the two receiving portions 22 of the uppermost connector housing 3 are inserted inside the detecting portions 26 of the cover 5, and the cover 5 is slid down. The receiving portions 22 are aligned vertically if the connector housings 3 are assembled properly. Thus, the detecting portions 26 of the cover 5 are slid smoothly along the receiving portions 22, and the cover 5 is assembled properly with the block 4 (see FIG. 19). In this case, the locking projections 24 fit into the locking recesses 23 of the uppermost connector housing 3 to lock the cover 5 on the block 4, as shown in FIG. 20. Hence, the assembling of the joint connector 1 is substantially completed.

On the other hand, at least one receiving portion 22 will not align vertically with the other receiving portions 22 if at least one connector housing 3 is not assembled properly. Then, the misaligned receiving portion 22 will interfere with the detecting portions 26 of the cover 5 and prevent the cover 5 from sliding completely over the front of the block 4. This enables an operator to know that the respective connector housings 3 are not assembled aligned properly.

FIG. 21 shows a state where the block 4 is fitted into a receptacle 17A provided in the electrical connection box 17 with the cover member 5 not mounted on the assembled block 4. The tabs 16 of the busbar that project into the receptacle 17A are inserted into the corresponding cavities 2 through the insertion openings 2B, and are connected with the terminal connecting portions 10 of the terminals 6.

According to this embodiment, a joint connection of two terminals 6 is provided. The two terminals 6 extend substantially in the same direction and the joint portion 15 of one terminal 6 is inserted into the terminal connecting portion 10 of the other terminal 6 from the front. As a result, the joint portion 15 is connected with the terminal connecting portion 10 to join the two terminals 6. With this construction, the joint portions 15 may be bent after the terminals 6 have been mounted in the cavities 2, and while the joint portions 15 project forward from the cavities 2 of the connector housing 3. In other words, it is not necessary to form openings in the side walls of the cavities as in the prior art connector. Rather, the joint portions 15 are connected with the terminals 6 located one stage above after the joint portions 15 project out of the cavities 2.

Further, the joint portions 15 of selected terminals 6 can be cut off from the terminal connecting portions 10 to accommodate a particular circuit configuration, so that joint connections easily can be provided only in selected positions.

In the typical case, several wiring harness subassemblies are combined to assemble a final wiring harness. For this typical situation, the terminals 6 are connected with ends of wires W to be joined with each other during the assembling of the subassemblies, and are accommodated in the cavities 2 of the connector housings 3. Then, if the connector housings 3 that are connected with the specified subassemblies are assembled one over another during the assembling of the final wiring harness, the wires W of the subassemblies are connected with each other via the terminals 6. The terminals that have been treated conventionally as later-inserted terminals T1 to T3 can be accommodated in the connector housings 3, and the formed subassemblies are of the complete type having no later-inserted terminals T1 to T3.

In addition, since the number of the connector housings 3 assembled one over another can be set arbitrarily, the joint connector can accommodate a circuit change by increasing or decreasing the number of the connector housings 3 according to the number of necessary joint connections or changing a combination of the connector housings 3.

The connector housings 3 can be assembled by fitting and sliding the grooves 19 and the elongated projections 20 on the opposing surfaces 3A, 3B. This sliding movement causes the joint portions 15 to be inserted automatically into the terminal connecting portions 10 of the adjacent terminals 6 to establish an electrical connection.

Although the joint portions 15 are exposed at the front surface of the block 4 constructed by assembling the connector housings 3 one over another, they are covered by mounting the cover member 5. Thus, the joint portions 15 are free from deformation due to an external force.

Further, whether the respective connector housings 3 are aligned can be judged by the sliding movement of the detecting portions 26 of the cover member 5 along the receiving portions 22 of the connector housings 3.

Figure 22:
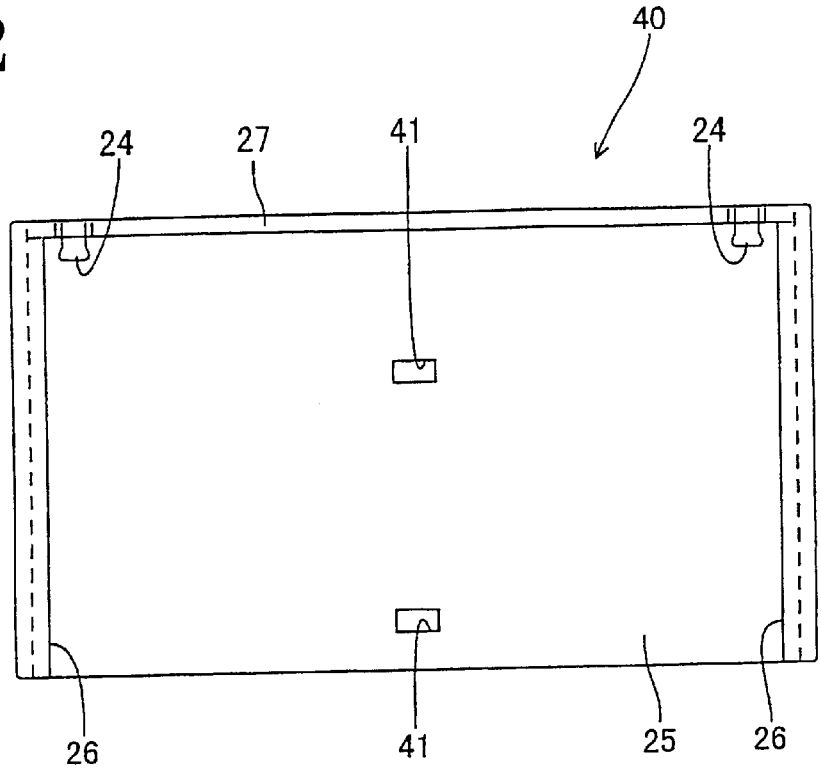
FIG. 22 is a rear view of a cover member according to another embodiment.
Figure 23:
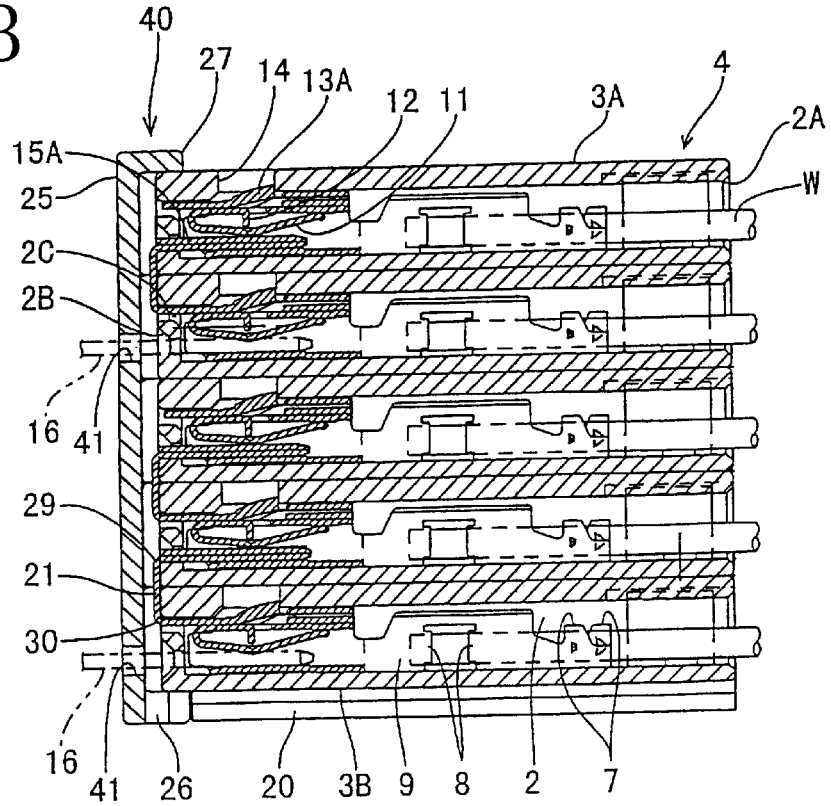
FIG. 23 is a section showing a state where the cover member according to another embodiment is mounted on the block.
Figure 24:
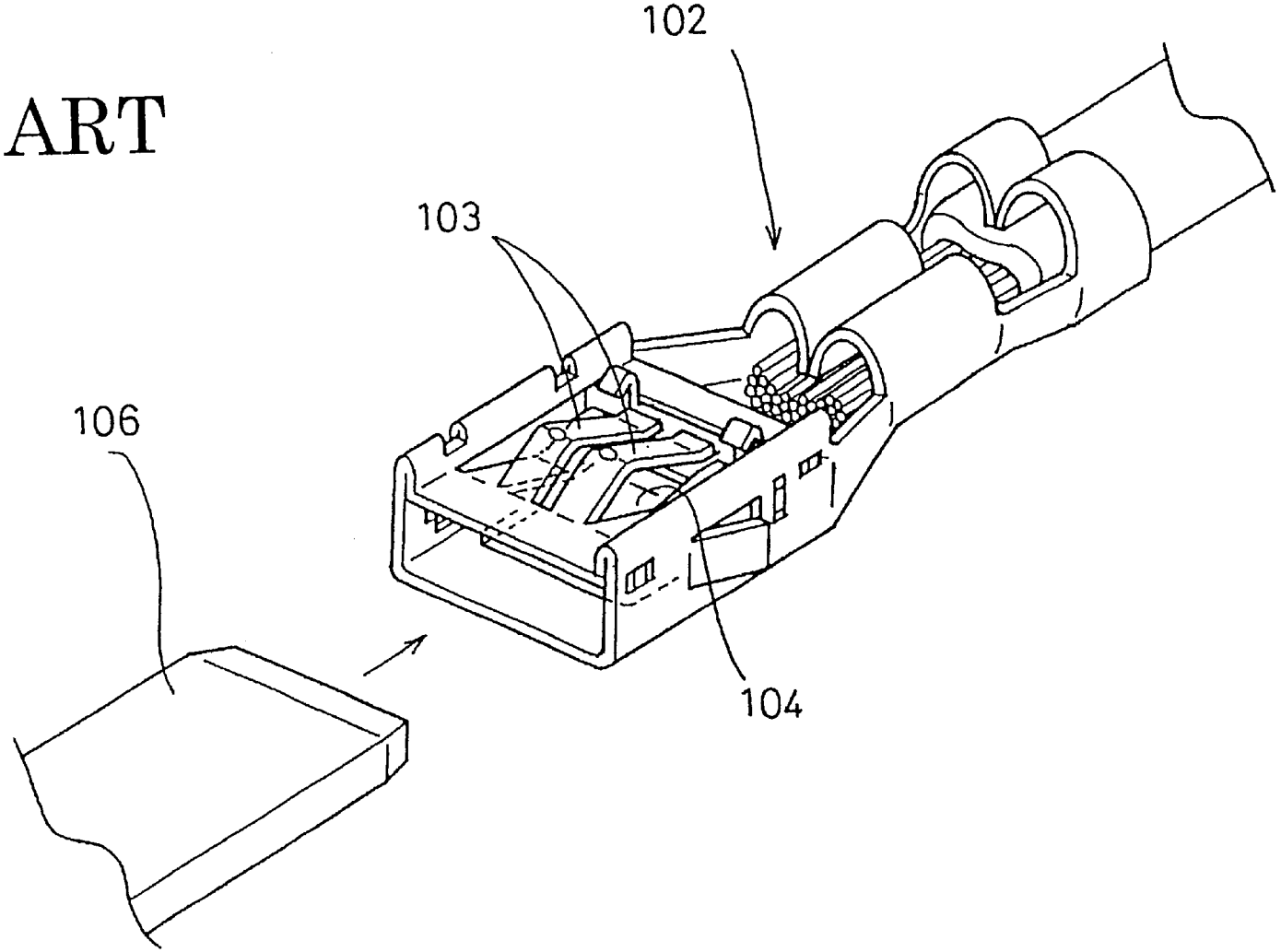
FIG. 24 PRIOR ART
FIG. 24 is a perspective view of a prior art terminal.
Figure 25:
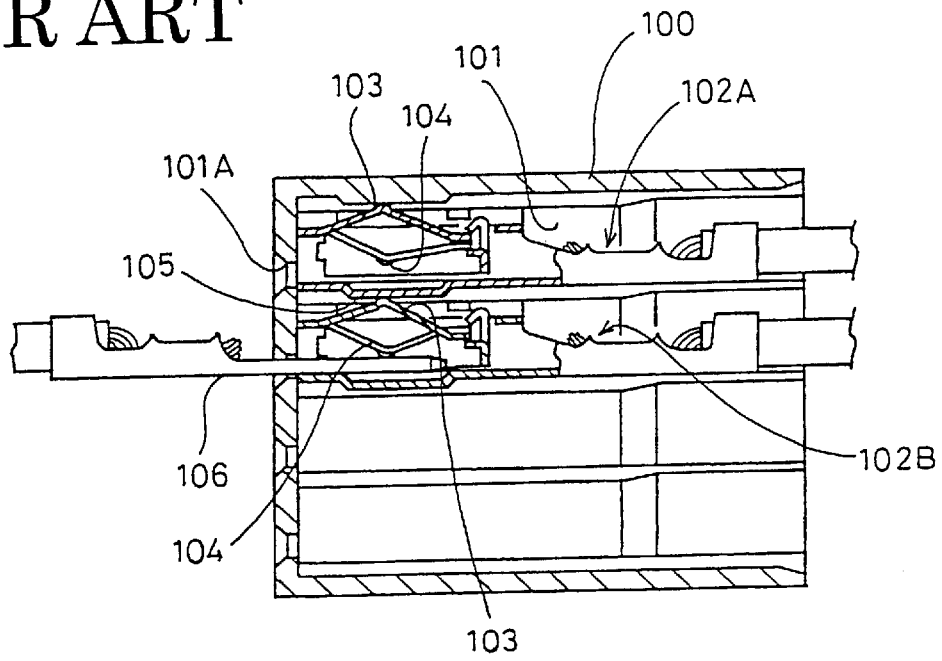
FIG. 25 PRIOR ART
FIG. 25 is a section of a prior art joint connector.
Figure 26:
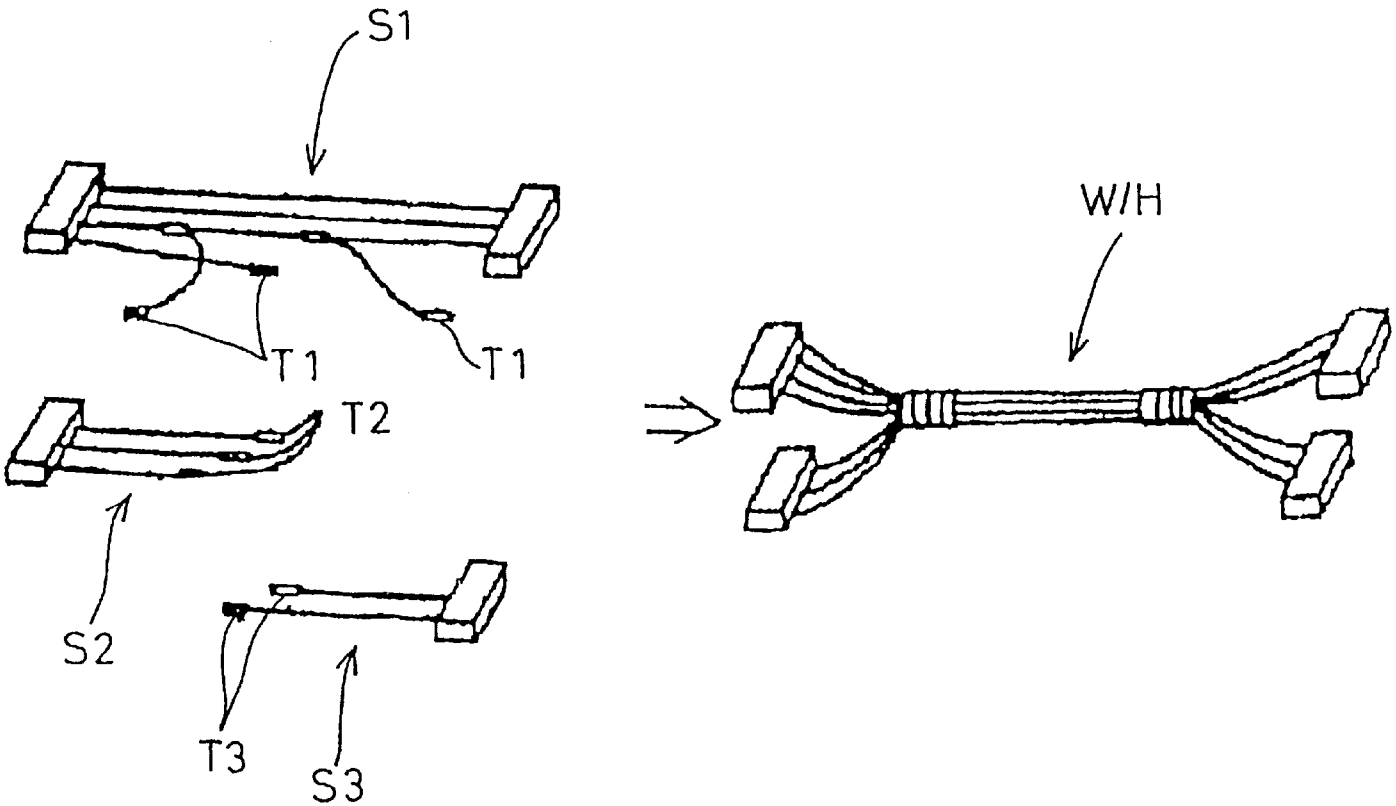
FIG. 26 PRIOR ART
FIG. 26 is a schematic view showing a prior art method of assembling a wiring harness from subassemblies.

FIGS. 22 and 23 show another preferred embodiment of the invention. This embodiment differs from the foregoing embodiment with respect to the cover 40. Accordingly, no description is given on the other construction by identifying it by the same reference numerals.

The cover 40 shown in FIG. 22 has substantially rectangular holes 41 extending in forward and backward directions. The rectangular holes 41 face the insertion openings 2B of the cavities 2 when the cover 40 is on the block 4. Thus, the tabs 16 of the busbar can be received from outside the block 4.

Tabs 16 of the busbar that are connected with wiring other than the terminals 6 accommodated in the block 4 can be connected with the terminal connecting portions 10 in the cavities 2 through the rectangular holes 41. Since the tabs 16 of the busbar can be received with the cover 40 on the block 4, the folded portions 21 exposed from the front surfaces of the connector housings 3 can be protected.

Further, since the positions of the rectangular holes 41 are specified, the tabs 16 of the busbar cannot be inserted through the rectangular holes 41 unless the positions thereof correspond with each other when the block 4 is fitted into the receptacle 17A of the electrical connection box 17. This prevents an incorrect block 4 from being fitted into the receptacle 17A.

It should be appreciated that various changes can be made in the present invention, and following embodiments are also embraced by the technical scope of the present invention as defined in the claims.

Although the wire connecting portions are the insulation-displacement portions 8 in the foregoing embodiment, they may be of the crimping type according to the present invention.

The cover 5 is mounted on the block 4 by being slid vertically with respect to the block 4 in the foregoing embodiment. However, the cover may be fitted to the block from front.

Although the grooves 19 and the elongated projections 20 are shown as a construction of the joining portion for assembling the upper and lower connector housings in the foregoing embodiment, various other constructions may be adopted for the joining portion according to the present invention.

What is claimed is:

1. A terminal having opposed front and rear ends, comprising:

a wire connecting portion disposed at the rear end for connection with an end of a wire;

a terminal connecting portion extending forwardly from the wire connecting portion to a location spaced rearwardly from the front end of the terminal; and a joint portion extending forward from the terminal connecting portion a selected distance to the front end of the terminal, a section of the joint portion being bent backward from the front end of the terminal a distance greater than the selected distance, whereby the bent backward section of the joint portion is configured for insertion into the terminal connecting portion of another said terminal.

2. A terminal according to claim 1, wherein the joint portion is substantially tab-shaped.

3. A terminal according to claim 2, wherein the joint portion is severable from the terminal connecting portion.

4. A terminal according to claim 1, wherein the bent backward section of the joint portion is substantially planar and substantially parallel to the terminal connecting portion.

5. A joint connector, comprising:

a plurality of connector housings, each said connector housing having opposed front and rear ends and being formed with substantially side by side cavities extending in forward and backward directions, said connector housings being disposed substantially adjacent one another such that each said cavity of one said connector housing is substantially adjacent at least one said cavity of the adjacent connector housing; and a plurality of terminals, each said terminal having opposed front and rear ends, the rear end of each said terminal defining a wire connection portion mounted in a respective one of the cavities, a terminal connecting portion disposed in the respective cavity forwardly of the wire connection portion, at least one of said terminals having a joint portion projecting from the terminal connecting portion and beyond the front end of the respective connector housing, the joint portion being folded back into a substantially into a U-shape and being connected as a joint partner to the terminal connecting portion of one of the terminals in one of said adjacent cavities.

6. A joint connector according to claim 5, wherein a section of the joint portion that is folded back is aligned substantially parallel to the corresponding cavity and is disposed outside the corresponding connector housing.

7. A joint connector according to claim 6, wherein the connector housings are assembled substantially one over another, and at least selected ones of the joint portions are inserted into the corresponding cavities of the connector housings one stage above and further into the terminal connecting portions of the terminals accommodated in the corresponding cavities to connect the terminals with each other.

8. A joint connector according to claim 7, wherein projections and recesses are provided on opposing surfaces of adjacent ones of the connector housings, the projections and the recesses of said adjacent housings being slid into engagement with each other for preventing the connector housings from separating, and wherein the joint portions of one said connector housing are inserted into the terminal connecting portions of the terminals in the adjacent connector housing as the connector housings are slid into engagement.

9. A joint connector according to claim 8, wherein a cover is mounted over the front ends of the respective connector housings for covering the folded sections of the joint portions at the front ends of the respective connector housings.

10. A joint connector according to claim 9, wherein receiving portions are provided in proximity to the front ends of the respective connector housings and are substantially aligned in vertical direction when the connector housings are assembled properly one over another, and wherein the cover is formed with a detecting portion which is slidably fittable to the receiving portions when the receiving portions are aligned, and wherein the detecting portion cannot slide over a misaligned receiving portion, thereby preventing complete mounting of the cover and providing an indication of an incomplete assembly of at least one of said connector housings.

11. A joint connector according to claim 10, wherein the cover is formed with rectangular holes in positions substantially corresponding to the cavities, said rectangular holes receiving the terminals as joint partners from outside of the block.

12. A method of assembling a joint connector, comprising:

providing at least first and second connector housings, each said connector housing having a front end and a rear end, a plurality of side by side cavities extending through each said connector housing from the front end to the rear end;

providing a plurality of terminals, each said terminal having opposed front and rear ends, the front end of each said terminal defining and elongate tab, the rear end being connected to a wire;

inserting the front end of each said terminal into a selected one of the cavities from the rear end of the connector housing such that the tab projects from the front end of the connector housing;

bending the a plurality of the tabs upward and rearward into a substantially U-shape;

sliding the second housing forwardly on the first housing such that the bent tabs of the first housing are slid into the cavities at the front end of the second housing.

13. The method of claim 12, further comprising cutting off at least one said tab.

* * * * *